US006945378B2

(12) United States Patent
Lundblad

(10) Patent No.: US 6,945,378 B2
(45) Date of Patent: Sep. 20, 2005

(54) ARRANGEMENT OF BANKNOTE HANDLING MACHINES FOR THE INFEED AND OUTFEED OF BANKNOTES

(75) Inventor: Leif Lundblad, Stockholm (SE)

(73) Assignee: Nybohov Development AB, Stockholm (SE)

( * ) Notice: Subject to any disclaimer, the term of this patent is extended or adjusted under 35 U.S.C. 154(b) by 202 days.

(21) Appl. No.: 10/363,704

(22) PCT Filed: Sep. 20, 2001

(86) PCT No.: PCT/SE01/02015

§ 371 (c)(1),
(2), (4) Date: Mar. 13, 2003

(87) PCT Pub. No.: WO02/27670

PCT Pub. Date: Apr. 4, 2002

(65) Prior Publication Data

US 2003/0168307 A1 Sep. 11, 2003

(30) Foreign Application Priority Data

Sep. 27, 2000 (SE) ..... 0003455

(51) Int. Cl.[7] ..... G07D 7/00
(52) U.S. Cl. ..... 194/206; 194/350; 186/37
(58) Field of Search ..... 194/206, 207, 194/302, 344, 350, 353; 186/37; 209/534; 109/58, 64, 67, 68; 902/30, 35; 705/35, 39, 44, 45

(56) References Cited

U.S. PATENT DOCUMENTS

| | | | | |
|---|---|---|---|---|
| 3,964,577 A | * | 6/1976 | Bengtsson | 186/37 |
| 4,365,700 A | | 12/1982 | Arimoto et al. | 194/2 |
| 4,511,795 A | | 4/1985 | Wood et al. | 235/379 |
| 4,577,763 A | | 3/1986 | Placke et al. | 209/534 |
| 4,744,468 A | | 5/1988 | Goi et al. | 209/534 |
| 4,775,783 A | | 10/1988 | Sasaki et al. | 235/379 |
| 4,890,824 A | | 1/1990 | Uchida et al. | 271/3.1 |
| 5,826,680 A | * | 10/1998 | Takemoto et al. | 186/37 |
| 6,006,989 A | | 12/1999 | Ademmer et al. | 235/379 |

FOREIGN PATENT DOCUMENTS

| | | | |
|---|---|---|---|
| EP | 0 164 717 | 12/1985 | G07D/1/00 |
| EP | 1 008 965 | 6/2000 | G07D/11/00 |
| GB | 2 007 626 | 10/1978 | B65H/31/30 |
| SE | 464 215 | 3/1991 | H04N/1/44 |
| SE | 9600801-6 | 2/1996 | |
| WO | WO-99/27488 A1 * | 6/1999 | G06K/9/00 |

* cited by examiner

*Primary Examiner*—Donald P. Walsh
*Assistant Examiner*—Mark Beauchaine
(74) *Attorney, Agent, or Firm*—Jacobson Holman PLLC

(57) ABSTRACT

A system for handling banknote flows with the aid of a banknote handling machine for feeding banknotes into and out of a banknote magazine included in the banknote handling machine. The system includes a central unit which includes a locality that is divided by an inner wall into an outer room and an inner room, with the banknote handling machine being orientated through the inner wall. The banknote handling machine includes a banknote infeed location and at least one banknote outfeed location in the outer room, and a combined banknote infeed/outfeed location in the inner room. The machine also includes a bandnote detector and a banknote packaging unit for treating possibly detected forged banknotes and unusable banknotes.

10 Claims, 2 Drawing Sheets

ARRANGEMENT OF BANKNOTE HANDLING MACHINES FOR THE INFEED AND OUTFEED OF BANKNOTES

This is a nationalization of PCT/SE01/02015 filed Sep. 20, 2001 and published in English.

FIELD OF INVENTION

The present invention relates to an arrangement, or system, of banknote handling machines, which function to feed banknotes in to and out from a banknote magazine included in respective machines.

DESCRIPTION OF THE BACKGROUND ART

Widely different kinds and designs of banknote handling apparatus and banknote handling arrangements have earlier been described in various documents, of which the following documents can be mentioned by way of example.

U.K. Patent Specification 2,007,626 (1979) describes a banknote dispensing apparatus in which banknotes are dispensed from a common banknote store to four different outfeed locations, i.e. to customer outlets. In the case of excessive withdrawals, the banknote store will be emptied more quickly than was calculated and therewith require the apparatus to be temporarily closed down.

U.S. Pat. 4,365,700 (1982) teaches a combined banknote receiving and dispensing machine. In the case of this machine, however, banknotes cannot be deposited and dispensed to several customers at one and the same time, due to the external design of the machine, therewith requiring a customer to choose between the deposit and withdrawal of banknotes while other customers must wait their turn.

Swedish Patent Specification 464 215 (1990) teaches a message receiving device, which includes a sheet store, printing mechanism and a store of enveloping or enclosing material for enclosing printed message sheets, all included in a closed casing.

Swedish Patent Application 9600801-6 (1997) teaches a banknote handler for the infeed, outfeed and storage of banknotes, including an infeed station, an outfeed station and a storage station.

One of the disadvantages of these earlier apparatus and also of other apparatus available in practice is that they cause the formation of queues or lines, resulting in irritation of the waiting customers.

SUMMARY OF THE INVENTION

A arrangement including a banknote handling machine of the aforesaid kind includes, in accordance with the invention, a locality which is divided by an inner wall into an outer room and an inner room. The banknote handling machine is orientated through the inner wall and one or more banknote infeed locations and banknote outfeed locations are provided in both the outer and the inner room. This will, of course, enable the quantity of banknotes contained by the machine to be used to a maximum while reducing the formation of lines or queues, at least to a significant extent. These and other characteristic features of an inventive arrangement will be apparent from the accompanying claims.

BRIEF DESCRIPTION OF THE DRAWINGS

The invention will now be described in more detail with reference to the schematic drawings, in which.

DESCRIPTION OF PREFERRED EMBODIMENTS

Figure 3:
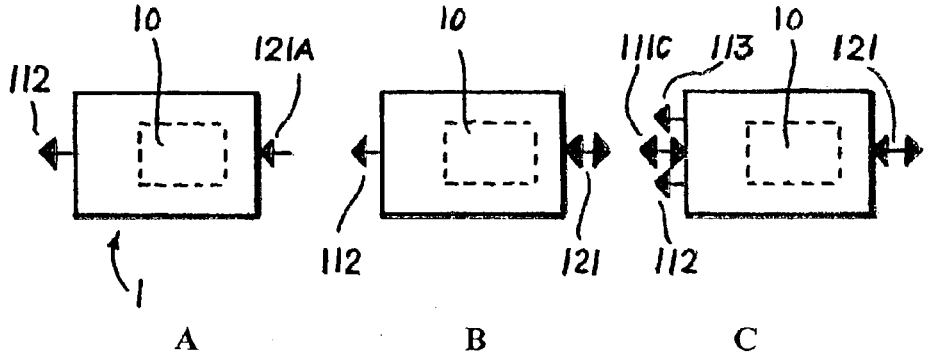
FIG. 3 illustrates different choices for infeed and outfeed locations in a banknote machine included in an inventive system.

Further scope of applicability of the present invention will become apparent from the detailed description given hereinafter. However, it should be understood that the detailed description and specific examples, while indicating preferred embodiments of the banknote handling machine, are given by way of illustration only, since various changes and modifications within the spirit and scope of the invention will become apparent to those skilled in the art from this detailed description. FIG. 3 illustrates a few representative configurations in this regard.

FIG. 3A shows a machine having a banknote infeed location 121A on the right-hand side of the machine 1, and a banknote outfeed location 112 on the left-hand side of the machine 1.

FIG. 3B shows a machine with the banknote infeed location 121A included in a combined banknote infeed/outfeed location 121 on the right-hand side of the machine and the banknote outfeed location 112 on the left-hand side of said machine.

FIG. 3C shows a machine with the banknote infeed/outfeed location 121 on the right-hand side of the machine and a banknote infeed/outfeed location 111C and two banknote outfeed locations 112, 113 on the left-hand side of the machine 1.

In every one of these instances, all locations are served by one and the same banknote magazine 10, which enables highly cost-effective banknote handling procedures to be achieved.

Figure 1:
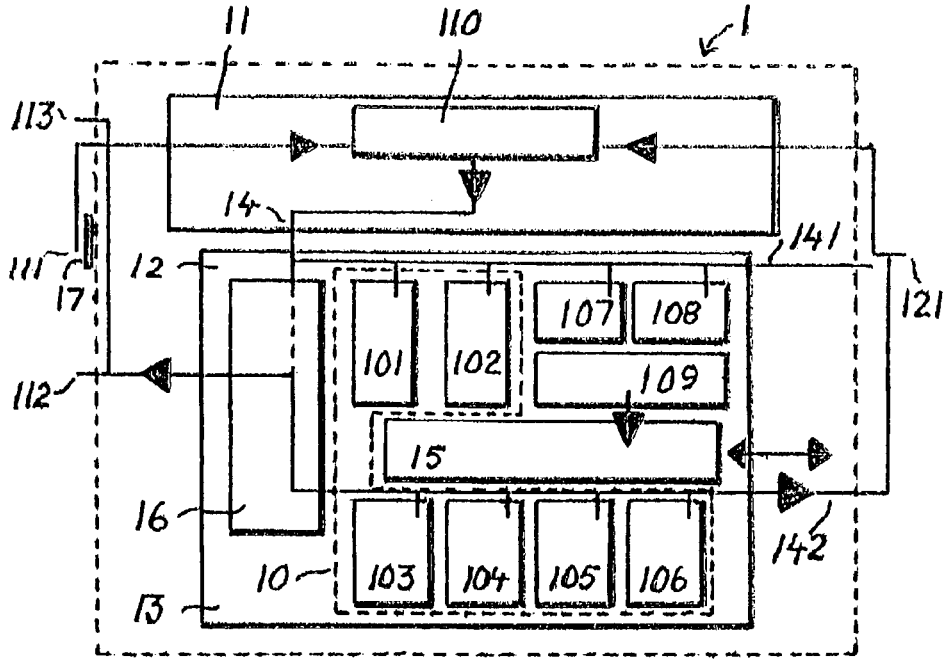
FIG. 1 illustrates a banknote handling machine included in an inventive arrangement.

The banknote handling machine 1 illustrated schematically in FIG. 1 for the infeed of banknotes into and the outfeed of banknotes from a banknote magazine included in said machine includes on one side (the left-hand side) a banknote infeed location 112 and two banknote outfeed or dispensing locations 112, 113, together with a common banknote infeed/outfeed location 121 on the opposite side of the machine (the right-hand side), wherewith all said locations are served by the banknote magazine 10 common to the banknote infeed and banknote outfeed facility.

The machine 1 can be said to consist of three main parts, namely:

- a processor plate 11 that includes a banknote detector 110 for identifying deposited banknotes to be handled by the machine, said banknotes being transported through said wall to a safety receptacle 12–13 in which the banknotes are stored;
- the upper part 12 of the safety receptacle, which includes two sub-magazines 101, 102 for banknote storage, two stacking units 107, 108, the upper part 141 of a common transport path 14, and a safety box 15; and
- the lower part 13 of the safety receptacle, which includes four sub-magazines 103, 104, 105 for banknote storage, and the lower part 142 of said common transport path 14.

Each of the sub-magazines 101–106 accommodates about 500 banknotes and said sub-magazines together form the banknote magazine 10.

The machine is designed to carry out the infeed of banknotes (deposit) and the outfeed of banknotes (dispense).

There will now be described in brief a number of functions which are effected in response to the control of a processor unit 16 common to the machine as a whole.

Banknote Receiving Function

The machine units will normally comprise a sub-magazine 101 that contains 0–500 banknotes of mixed denominations. The sub-magazine 102 is empty, the stacker unit 107 is empty, the stacker unit 108 contains banknotes of low quality in a number ranging from 0–100, the safety box 15 may contain "disposable cassettes" (plastic-wrapped) containing banknotes (100 banknotes in each cassette).

Receiving banknotes with an escrow function:

A customer places a bundle of banknotes (a maximum of 400 in number) in a deposit compartment 17. The banknotes in the bundle are fed singly through the banknote detector 110 for identification and classification (quality, validity). The banknotes are then fed into the sub-magazine 102, although with the exception of banknotes that are deemed to be "forgery suspects"—these banknotes are fed into the stacker unit 107. If the customer is unsatisfied with the deposit, the banknotes are fed back from the sub-magazine 102 to the outfeed compartment 17 and therewith restored to the customer (with the exception of any suspected forged banknotes). The following procedures take place when the customer accepts the transaction:

- low quality banknotes are fed from the sub-magazine 102 to the stacker 108;
- good quality banknotes of denominations that can later be used for dispensing purposes are transferred from the sub-magazine 102 to respective sub-magazines 103–106, each of which contains banknotes of solely one denomination (SEK 50, 100, 500, 1000);
- banknotes of "small denominations" (e.g. SEK 20) are transferred to the sub-magazine 101; there is no sub-magazine for banknotes of such small denomination.

The transaction is now ended. If the stacking unit 107 contains "suspected forgeries", these banknotes are packaged by packaging unit 109 in a one-time cassette, which is marked with the transaction number concerned and fed down into the safety box 15.

When the stacking unit 108 contains "sufficient" low denomination banknotes (e.g. 100 in number), the processor unit 16 orders the machine to package the content of said unit in a one-time cassette and feed the cassette into the safety box 15.

Banknote reception in the absence of an escrow function:

The customer places a bundle of banknotes (max 400 in number) in the infeed or deposit compartment 17. These banknotes are then fed through the banknote detector for identification and classification. The infeed of banknotes takes place as follows:

- Good quality banknotes of denominations that can be dispensed from the machine are fed directly down into respective denomination sub-magazines.
- Low quality banknotes are fed directly to the stacking unit 100.
- Banknotes of "small denominations" are fed directly into the sub-magazine 101.
- "Suspected forgeries" are fed into the stacker unit 107.

The transaction is now ended. If the stacking unit 107 contains "suspected forgeries", these banknotes are packaged by packaging unit 109 in a one-time cassette, which is marked with the transaction number concerned and fed down into the safety box 15. If the stacker unit 108 contains "sufficient" banknotes of low quality, the machine is ordered to package the content of said unit in a one-time cassette and to feed the cassette into the safety box 15.

Outfeed of Banknotes (Dispensing)

When dispensing banknotes to customers, banknotes are fed from respective denomination sub-magazines 103–106. The outfeed of banknotes is effected denomination-by-denomination from one sub-magazine at a time in an order desired by the customer.

Outfeed of "Small Denominations":

Shop owners who deposit their daily takings sometimes have the need for low denomination banknotes at the same time. Accordingly, the machine is able to dispense banknotes of small denomination from the sub-magazine 101 to customers that have made a deposit. Because the banknotes in this sub-magazine are of mixed denomination, the dispensing of such banknotes will generally take a longer time to carry out.

Other Functions

As illustrated schematically in FIG. 1, the machine includes transport paths for additional functions, such as:

- Movement of banknotes between respective denomination sub-magazines, for example to change banknote denominations in a sub-magazine. (At the beginning of each month, the requirement in Sweden for 500-kronor banknotes is smaller than the end of the month).
- Ordering the machine to move banknotes from denomination sub-magazines to a stacker unit for packaging the banknotes in one-time cassettes if the machine considers that it has too many banknotes of a given denomination.
- Concurrent depositing and dispensing of banknotes. In order to shorten transaction times, the banknote receiving function often utilises the entire machine, i.e. also denominational sub-magazines 103–106. If the machine is ordered to dispense banknotes under these conditions, the banknote receiving function switches to the use of solely the upper part of the machine during the banknote dispensing period and then returns to utilising the whole of the machine for the banknote depositing function.

Figure 2:
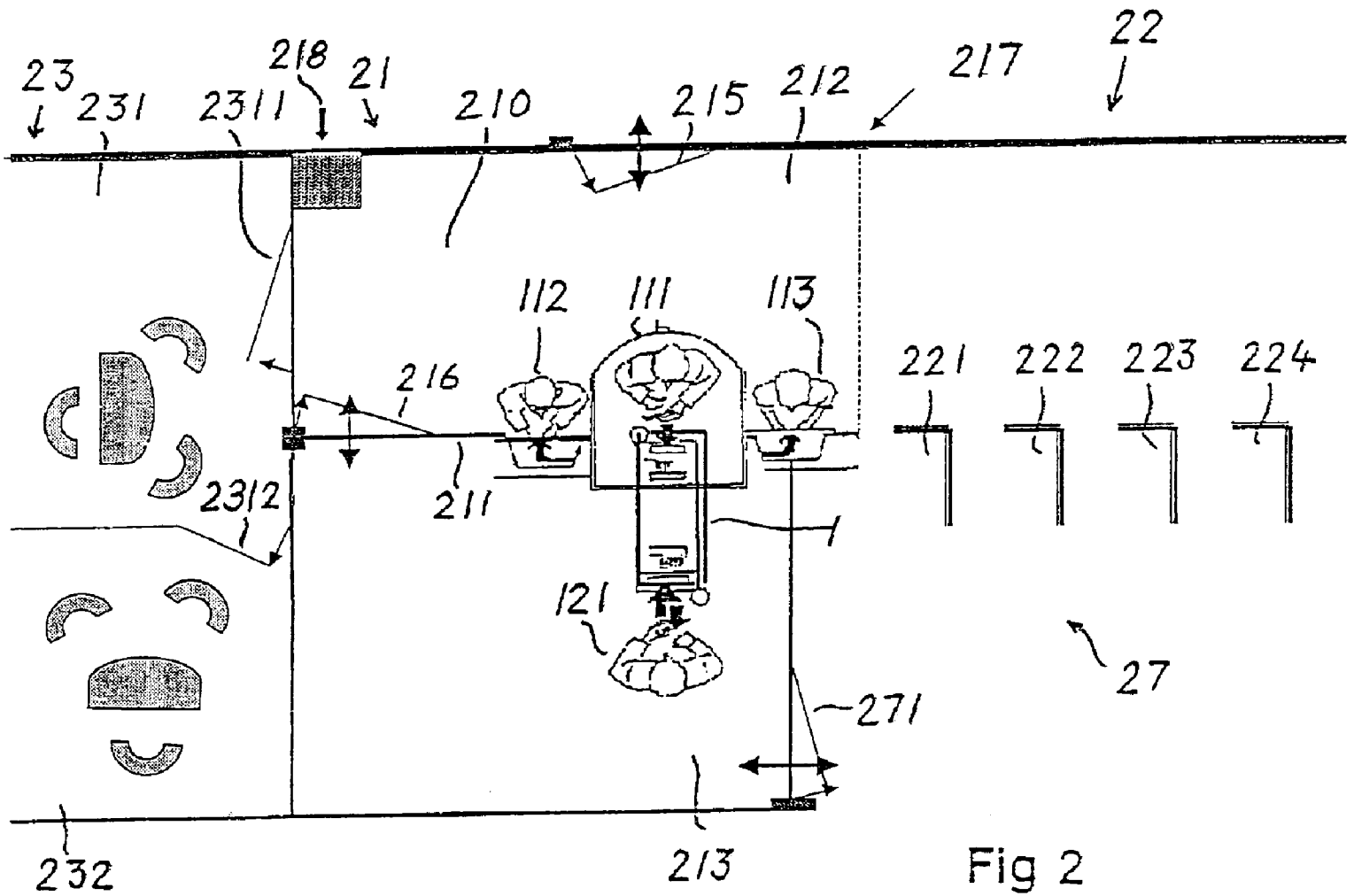
FIG. 2 illustrates the use of the banknote handling machine of FIG. 1 in an arrangement or system for maximum cost-effective handling of the flow of banknotes in a given area served by said arrangement.

The system or arrangement illustrated schematically in FIG. 2 in which the aforedescribed banknote handling machine 1 is included comprises a first unit 21, the central unit, which includes a locality 210 which is divided by an inner wall 211 into an outer room 212 and an inner room 213, with a banknote handling machine 1 orientated through the wall 211. This machine includes an infeed (depositing) location 111 and two outfeed (dispensing) locations 112, 113 in the outer room, and a common infeed and outfeed location 121 in the inner room. The banknote handling machine 1 is of the kind that includes detection means and packaging means for treating any forged banknotes that may be detected, together with unusable (dirty, torn) banknotes. The bank customers enter the inner room 212 through an outer door 215, for the purpose of withdrawing and depositing sums of money, and tellers enter the inner room 213 from outside through an inner door 216, for the purpose of collecting a till float or the like in the morning and depositing daily takings in the evening.

The illustrated arrangement also includes a second unit 23, bank/shop unit, which is located adjacent the central unit 21 and has a first department 231 Which enables passage in and out through doors 2311 from and to the outer room 212 of the central unit and passage in/out through doors 2312 to and from a second department 232.

The department 231 is intended for traditional bank errands, so-called cash errands, and the department 232 is intended for more or less complicated bank business with individual customers.

A third unit 22 (the shop unit) is arranged adjacent the central unit 21 and includes cash points (pay counters) 221–224, four in number, for a shop 27 that sells everyday commodities, with the possibility of passing in and out through door 271 to and from the inner room 213 of the central unit. Till (cash register) operators serving the cash points of the store or shop 27 can therewith conveniently take the sums of money required for their respective till floats. Fitted between the outer room 212 of the central unit 221 and the shop or store unit is a shutter arrangement 217 which is closed when the shop is not open to the public. Thus, the aforementioned door 215 functions as an entrance for both bank customers and shop customers. An inquiry terminal 218 for displaying, e.g., a balance statement from the bank or the shop is provided adjacent the outer door 215.

The manner of the arrangement of the banknote infeed and outfeed locations of the banknote handling machine will, to some extent, depend on the nature of the customer scenario within the geographically restricted area. A single customer who deposits a bundle of banknotes can occupy a location over a period of time corresponding to that required for 10–20 customers to take out the sums that they have ordered.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. An arrangement or system for handling of banknote flows within a given geographically restricted area served by the system using a banknote handling machine for feeding banknotes into and out of a banknote magazine included in the banknote handling machine, said system comprising:

a central unit, which includes a locality which is divided by an inner wall into an outer room and an inner room, with the banknote handling machine orientated through the inner wall;

said banknote handling machine including an infeed or deposit location and at least one outfeed or withdrawal location in the outer room, a combined infeed/outfeed location in the inner room, and a banknote detector and a banknote packaging unit for treating any forged and unusable banknotes that may have been detected.

2. The system according to claim 1, further comprising a bank/store unit, which borders on the central unit and includes a first department which enables direct passage from and to the outer room of the central unit and which is intended for traditional bank errands, and also including a second department which enables passage from and to the first department and which is intended for banking business with individual customers.

3. A The system according to claim 1, further comprising a store unit, which borders on the central unit and includes pay counters and which enables direct passage to and from the inner room of the central unit and therewith to and from the bank handling machine situated in said inner room.

4. The system according to claim 1, wherein the banknote handling machine includes at least one banknote infeed location and at least one banknote outfeed location, said locations being served by said banknote magazine for the infeed and outfeed of banknotes, said infeed location being included in a combined banknote infeed/outfeed location.

5. A The system according to claim 4, wherein the banknote handling machine includes a further combined infeed/outfeed location and a further banknote outfeed location, said further locations also being served from said banknote magazine.

6. A system for handling banknote flows within a given geographically restricted area served by the system, comprising:

a central unit divided by an inner wall into an outer room and an inner room;

a banknote handling machine for feeding in and feeding out banknotes, said banknote handling machine being orientated through the inner wall and including an infeed location and an outfeed location in the outer room, an infeed and outfeed location in the inner room, a banknote detector and a banknote packaging unit for treating any forged and unusable banknotes that may have been detected.

7. The system according to claim 6, further comprising a bank/store unit, which borders on the central unit and includes a first department that enables direct passage from and to the outer room of the central unit for cash errands, and a second department that enables passage from and to the first department for banking business with individual customers.

8. The system according to claim 6, further comprising a store unit, which borders on the central unit and includes pay counters, said store unit enabling direct passage to and from the inner room of the central unit and therewith to and from the bank handling machine situated in said inner room.

9. The system according to claim 6, wherein the banknote handling machine includes at least one banknote infeed location and at least one banknote outfeed location, said locations being served by a common banknote magazine for the infeed and outfeed of banknotes, said infeed location being included in a combined banknote infeed/outfeed location.

10. The system according to claim 9, wherein the banknote handling machine includes a further combined infeed/outfeed location and a further banknote outfeed location, said further locations also being served from said common banknote magazine.

* * * * *